US005718336A

United States Patent [19]

Haarlander

[11] Patent Number: 5,718,336

[45] Date of Patent: Feb. 17, 1998

[54] LUNCH BOX ASSEMBLY

[76] Inventor: Michael Haarlander, 9455-A Boca Gardens, Boca Raton, Fla. 33496

[21] Appl. No.: 596,515

[22] Filed: Feb. 5, 1996

[51] Int. Cl.[6] ..... A45C 11/20

[52] U.S. Cl. ..... 206/542; 206/541; 206/232; 206/457; 206/778

[58] Field of Search ..... 206/232, 472, 206/457, 459.5, 541, 542, 545, 575, 769, 771, 778; 40/312, 313, 649, 661

[56] References Cited

U.S. PATENT DOCUMENTS

| | | | |
|---|---|---|---|
| 3,415,407 | 12/1968 | Alden | 40/312 |
| 3,777,418 | 12/1973 | Cooper | 206/542 |
| 3,849,917 | 11/1974 | Bergh et al. | 40/649 |
| 4,041,630 | 8/1977 | Holbrook | 40/649 |
| 4,413,434 | 11/1983 | Rupert et al. | 40/661 |
| 4,718,550 | 1/1988 | Johnson | 206/472 |
| 4,767,003 | 8/1988 | Rice et al. | 206/232 |
| 5,148,618 | 9/1992 | Brewster | 40/661 |
| 5,396,999 | 3/1995 | Sandheinrich | 206/541 |

FOREIGN PATENT DOCUMENTS

| | | | |
|---|---|---|---|
| 2298976 | 8/1976 | France | 206/459.5 |
| 3326653 | 2/1985 | Germany | 206/459.5 |

*Primary Examiner*—David T. Fidei
*Attorney, Agent, or Firm*—Malloy & Malloy, P.A.

[57] ABSTRACT

An improved lunch box assembly including a main housing having a lid portion and a base portion hingedly secured with one another so as to provide access to an opened interior of the improved lunch box assembly. Further, a display panel is included and secured in overlying relation to one exterior wall surface of the main housing so that it defines a pocket therebetween which is visually accessible through a display opening defined in the display panel. Also, a display insert is included and structured to be removably inserted into the pocket between the display panel and the exterior wall surface so that a primary display face thereof is visible through the display opening in the display panel and so that while it is securely maintained within the pocket when in use it can also be easily removed for convenient cleaning or interchanging with a new display insert.

10 Claims, 2 Drawing Sheets

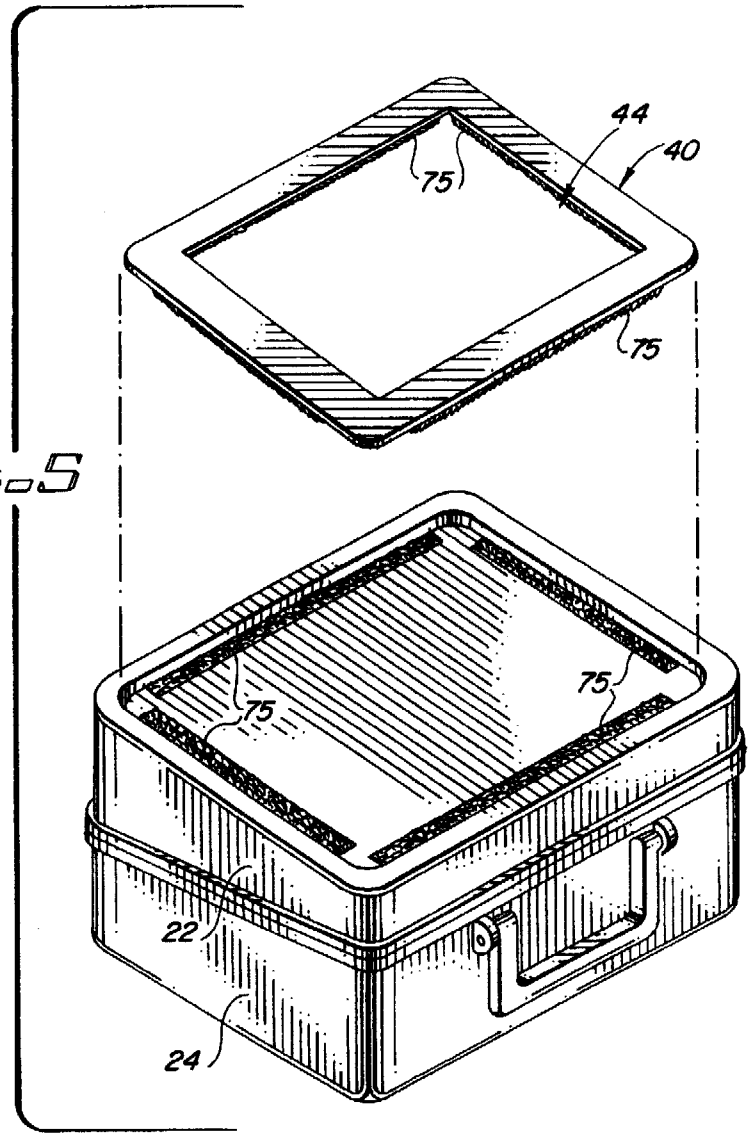
FIG. 5
FIG. 3
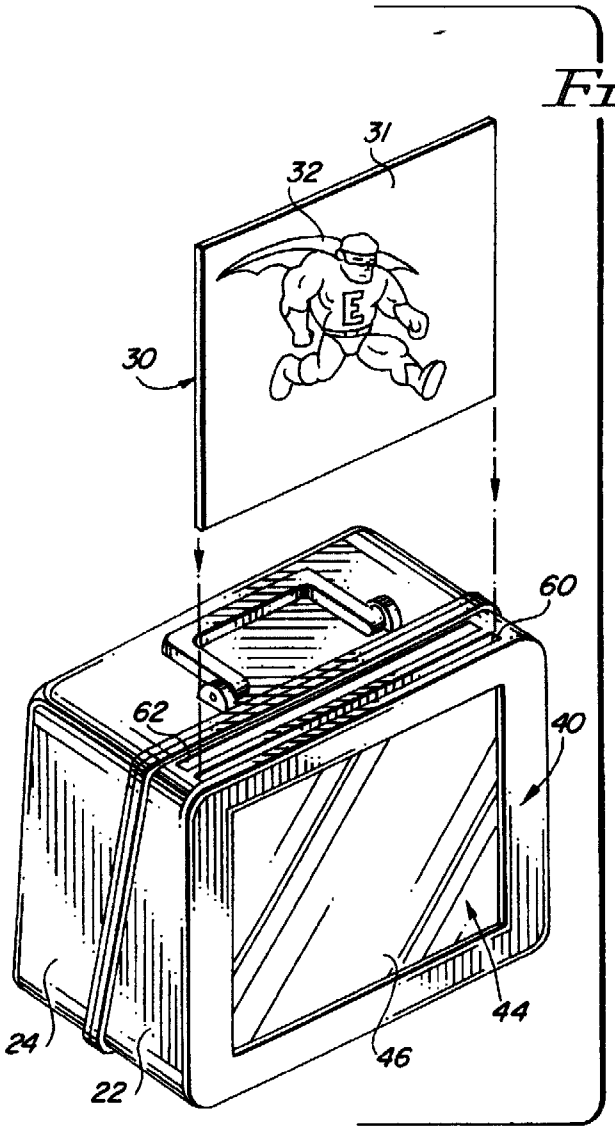

LUNCH BOX ASSEMBLY

BACKGROUND OF THE INVENTION

1. Field of the Invention

The present invention relates to an improved lunch box assembly which allows a user to alternate between several different design indicia, such as cartoon characters, sports figures, super-heros, movie/television stars, logos, designs, and the like, and which substantially extends the useful life of the lunch box and its decorative indicia after repeated washings.

2. Descriptions of the Related Art

It is well-known that lunch boxes, particularly those oriented for use by children, are invariably decorated or embellished with a wide variety of indicia. Children are naturally attracted to lunch boxes displaying their favorite images such as popular television and cartoon characters, super-heroes, and the like. Unfortunately, as many parents have realized, a child's current favorite lunch box decorative indicia will not long remain the child's favorite. Parents as well as manufacturers and retailers have realized that a child's choice of a lunch box design is impulsive and whimsical. Typically, a child's admired super hero, cartoon character, or movie hero will change several times before the lunch box has undergone its useful life.

In most cases, the child abandons the now outdated, but perfectly usable lunch box, and purchases another one with more desirable indicia imprinted on it. Seldom are parents able to convince a child to continue using the lunch box with the disfavored design. The unfortunate result is that although a lunch box may be fairly new, mechanically sound, and perfectly functioning, a child may no longer be willing to use it simply because his choice of superhero, cartoon character, or other indicia has changed. The problem is that changes in children's lunch box indicia preferences are likely to be very frequent, considering the large number of new action films, movies, cartoons, and television series released per year. In addition, there are a multitude of preference changes which take place among existing designs.

Another problem frequently faced by existing lunch box designs relates to the fading and discoloration of decorative indicia and/or the disintegration over time of decals bearing the decorative indicia. Such fading, discoloration, disintegration is primarily caused by the repetitive washing of the lunch box. In particular, in existing lunch box designs, the decorative indicia is an integral part of the exterior wall of the lunch box. As such, the decorative indicia must be washed every time the lunch box is cleaned. This repetitive washing of the decorative indicia causes it to fade and wear out from the continuous exposure to chemical soaps and water. The wearing out and fading of the decorative design on the lunch box substantially reduces its useful life and detracts from the overall appearance which makes it attractive to children. Unfortunately in the existing art, there is no practical way to wash the lunch box without also washing the decorative indicia and accelerating its deterioration. Although the lunch box may still be mechanically in-tact and functionally working, the faded and worn indicia no longer makes the lunch box desirable and substantially reduces it's actual useful life. As such, the only viable option when the lunch box indicia is worn and faded or when the user desires to otherwise change the decorative indicia is too discard and replace the entire lunch box.

Accordingly, there is still a need for an improved lunch box assembly which allows a user to easily replace the decorative indicia on the exterior side wall of a lunch box with a different decorative indicia and which also allows the user to easily remove the decorative indicia while the lunch box is being washed so as to prevent premature wearing or fading of the decorative indicia and thus extend the useful life of the lunch box.

SUMMARY OF THE INVENTION

The present invention is directed towards an improved lunch box assembly which allows a user to alternate between several different, longer lasting designs. In particular, the improved lunch box assembly includes a main housing having both a lid portion and base portion. The lid portion is hingedly secured to the base portion in a conventional fashion so as to be openable and provide access to an open interior of the main housing.

The main housing further includes at least one exterior wall surface. Moreover, secured to that exterior wall surface, in overlying relation thereto, is a display panel. The display panel is structured and disposed to define a pocket between itself and the exterior wall surface, and includes a display opening defined therein and structured to provide visual access to the pocket and its contents therethrough.

Structured to be removably inserted into the pocket between the display panel and the exterior wall surface is a display insert. The display insert is positioned so that a primary display face thereof is visible through the display opening defined in the display panel. Additionally, so as to permit and facilitate removable access of the display insert into and out of the pocket between the display panel and the exterior wall surface, the improved lunch box assembly includes access means. The access means are structured to securely maintain the display insert, while permitting facilitated removal so that the housing may be completely cleaned without damaging the display insert, and such that the insert may be interchanged with a new, different display insert.

It is an object of the present invention to provide an improved lunch box assembly which allows a user to alternate between several different display inserts imprinted with various decorative indicia in order to vary the appearance and appeal of the lunch box.

It is a further object of the present invention to provide an improved lunch box assembly which allows a user to easily remove the decorative indicia while the lunch box is being washed so as to substantially increase the useful life of the lunch box by preventing the premature wearing or fading of the decorative indicia due to repetitive exposure to chemical soaps and water.

Yet another object of the present invention is to provide a lunch box which can be washed in a dish washer without detracting from its in use exterior appearance.

BRIEF DESCRIPTION OF THE DRAWINGS

For a fuller understanding of the nature of the present invention, reference should be had to the following detailed description taken in connection with the accompanying drawings in which:

FIG. 3 is a perspective view of the preferred embodiment of the improved lunch box assembly in which the access means includes a slot formed at an edge of the pocket;

FIG. 5 is a perspective view showing an embodiment of the improved lunch box assembly in which the display panel is removably secured to the exterior wall surface through the use of a plurality of hook and loop fastener strips.

Like reference numerals refer to like parts throughout the several views of the drawings.

DETAILED DESCRIPTION OF THE PREFERRED EMBODIMENTS

Figure 1:
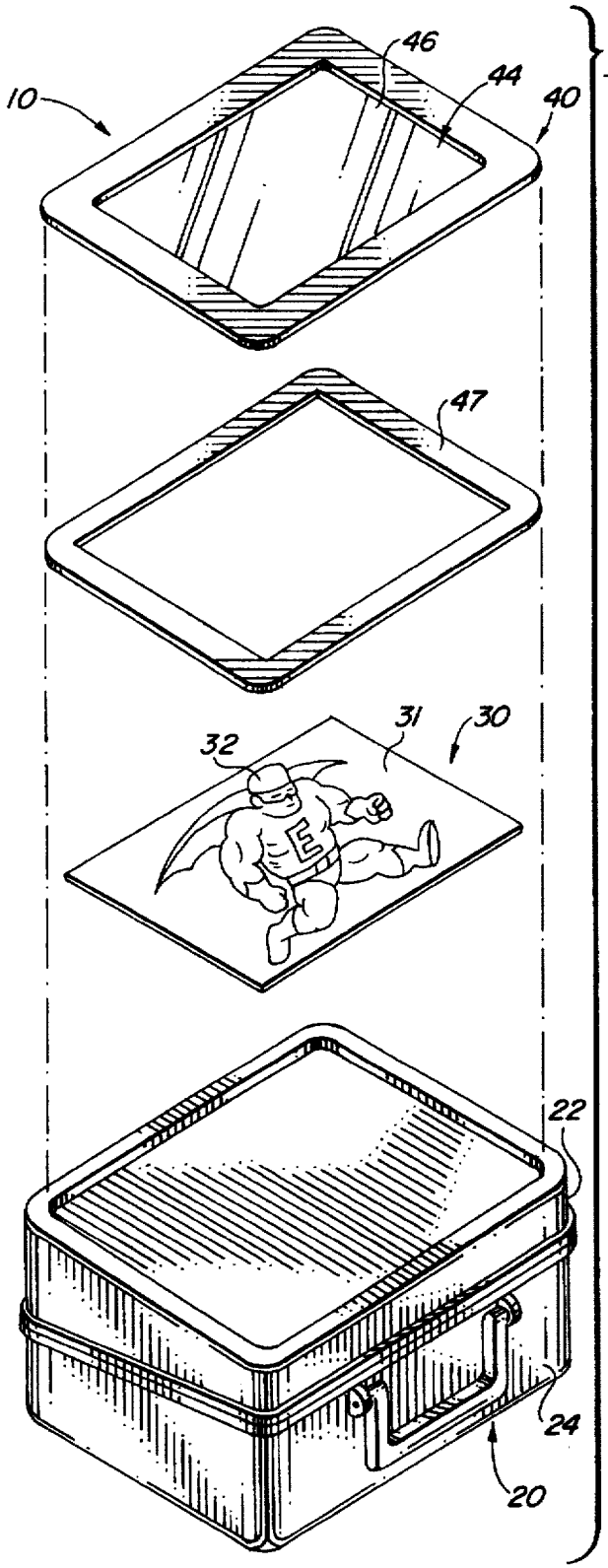
FIG. 1 is a perspective view of the improved lunch box assembly in its dis-assembled form.
Figure 2:
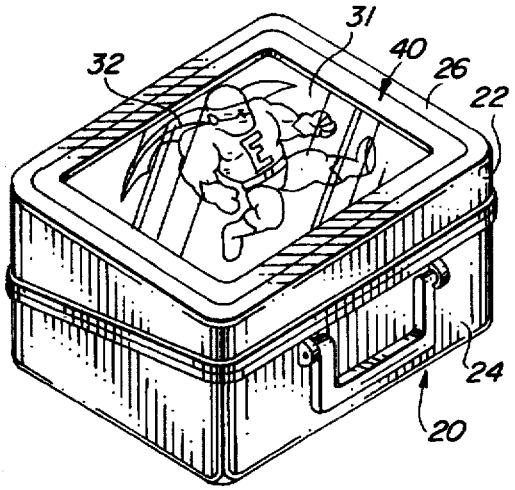
FIG. 2 is a perspective view showing the improved lunch box assembly in its assembled form.

Shown throughout the Figures, the present invention is directed towards an improved lunch box assembly generally indicated as 10. The improved lunch box assembly 10, which is structured to be used in a similar manner to a conventional lunch box so as to contain food and other items, includes a main housing 20 having primarily a lid portion 22 and a base portion 24. In any conventional fashion, the lid portion 22 and the base portion 24 are hingedly secured to one another, and as such rotate relative to one another so as to provide access to an open interior of the housing 20. Further, the housing 20 may be constructed in any desired geometric configuration and of any acceptable, generally rigid material such as plastic or metal, and will include at least one, preferably planer, exterior wall surface 26. Preferably, however, so as to provide for cost effective manufacturing and convenient use, the housing will include a generally rectangular configuration and accordingly a pair of opposite, exterior wall surfaces. Further, it should be noted that other lunch box type containers such as pencil boxes and the like could be equivalently equipped.

Disposed in secure, overlying relation to at least one, but alternatively each exterior wall surface 26 of the lid portion 22 and/or the base portion 24 of the housing 20 is a display panel 40. The display panel 40 preferably substantially overlies the entire exterior wall surface 26 of the housing 20, and is structured to be secured thereto, in generally spaced apart relation and preferably about a substantial perimeter thereof. It is noted, however, that in an alternative embodiment the display panel 40 may only overlie a perimeter edge of the exterior wall surface to define a narrow frame type edge. Accordingly, the display panel 40 functions to define a pocket between itself and the exterior wall surface 26 of the housing 20. Further, so as to provide exterior access to the pocket defined between the display panel 40 and the exterior wall surface 26, the improved lunch box assembly 10 includes access means defined therein.

In a preferred embodiment, as illustrated in FIG. 3, the display panel 40 is integrally molded with the lid portion 22 of the housing 20 about the perimeter edge of the exterior wall surface 26. As such, an integrally formed lip portion extends upwardly from the exterior wall surface 26 to define a depth of the pocket, and is molded with the display panel 40. Further, in this embodiment, the access means include a generally elongate slot 60. Preferably, the elongate slot 60 is formed in the perimeter lip portion and extends substantially along an entire perimeter edge of the display panel 40 to permit more complete access to the pocket. Additionally, if desired, a separate or hingedly attached cap 62 may be disposed to overly the elongate slot 60 and selectively seal off access to the pocket between the display panel 40 and the exterior wall surface 26 of the housing 20 when desired. As such, the cap 62, which is structured to move between an open orientation wherein the slot 60 is accessible and a closed orientation wherein the slot 60 is concealed, will function to keep debris, water, and other foreign materials from falling through the slot 60.

Figure 4:
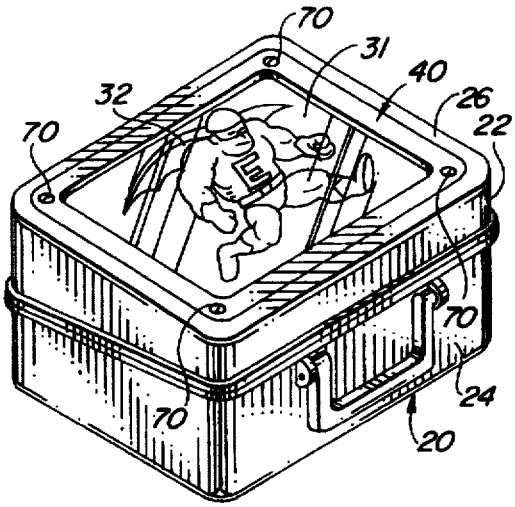
FIG. 4 is a perspective view showing an embodiment of the improved lunch box assembly in which the display panel is removably secured to the exterior wall surface through the use of fastener elements.

Turning to FIGS. 1, 4, and 5, in alternative embodiments of the present invention, the display panel 40 may be a separate component structured to be removably secured to the exterior wall surface 26 of the housing 20. As such, the manner of securing the display panel 40 in place on the exterior wall surface 26 functions as the access means to permit access to the pocket.

Preferably, so as to provide for a smooth exterior surface, the exterior wall surface 26 includes a recess sized to receive the display panel 40, in a flush manner therein. Furthermore, the display panel 40 may be structured to be snap-fitted in place atop the exterior wall surface, or otherwise removably secured in place. For example, as in the embodiment of FIG. 4, a plurality of elongate fastener elements 70 may removably extend through the display panel 40 and into the exterior wall surface 26 of the housing 20. As such, when access to the pocket is desired, the fastener elements 70 must merely be removed to permit removal of the display panel 40. Also, as illustrated in FIG. 5, a plurality of hook and loop fastener strips 75 may be confrontingly disposed on the exterior wall surface 26 and the display panel 40. Such would provide for more facilitated removal of the display panel 40 and access to the pocket. It should be noted that any means of maintaining the display panel 40 and the exterior wall surface 26 removably secured with one another, such as through clips, a biased hinge, latches, etc., may also be equivalently implemented.

The display panel 40 of the present invention further includes a display opening 44 defined therein. The display opening 44, which is preferably substantially large, is structured to permit visual access to the pocket between the display panel 40 and the exterior wall surface 26, and its contents. As such, the display opening 44 preferably extends through the display panel 40, much like a frame or window opening having a perimeter flange, namely the display panel 40 itself, surrounding and defining the display opening 44. Although the display opening 44 may be completely open, in a preferred embodiment a transparent material panel 46 is disposed over the display opening 44 so as to enclose and protect the contents of the pocket without eliminating the visual access provided by the display opening 44. The transparent material panel, which is preferably a transparent plastic material in order to maximize safety, may be a separate element which is captivated in place between the display panel 40 and the exterior wall surface 26, or may be integrally molded with and/or fixedly secured to the display panel 40. In the case of a completely removable display panel 40, the molded transparent material panel and the secure fit of the display panel 40 on the exterior wall surface 26 may even function to maintain a fluid impervious seal to keep water from seeping into the pocket. Accordingly, during washing of the housing, the pocket will remain substantially dry. Further, a separate gasket element 47 may also be included between the display panel 40 and the exterior wall surface 26 in order to further the seal. It should also be noted that the entire display panel 40 may in fact be transparent and define the display opening 44, thereby eliminating the need for a separate transparent material panel.

Further included with the improved lunch box 10 of the present invention is at least one display insert 30. The display insert 30 is structured to be removably inserted into the pocket between the display panel 40 and the exterior wall surface 26 so as to be maintained therein during use of the lunch box 10. Moreover, the display insert 30 includes a primary display face 31 which is structured and disposed to be visible through the display opening 44 defined within the display panel 40.

In particular, the display insert 30 is preferably a laminated card bearing indicia 32 such as cartoon characters, super-heros, movie/television stars, logos, symbols, designs, and the like on its primary display face 31. It will be apparent to those skilled in the art that any one of a number of known means of imprinting the display insert 30 will be satisfactory. Accordingly, a user is able to separately purchase or have different display inserts 30, each bearing different indicia 32 on its primary display face 31, such that when desired the display panel 40 can be removed or the pocket otherwise accessed in order to remove a current display insert and replace it with a new display insert. A user of the improved lunch box assembly 10 is therefore able to vary their lunch box to a desired decoration, be it a seasonal decoration, a currently in fashion or desired decoration, a continuous cartoon-type series insert wherein each day has the next frame of a comic strip, a sports decoration, etc. As can be appreciated, as trends change and newer or different indicia are demanded, such display inserts 30 may be manufactured and sold separately from the improved lunch box assembly 10. As such, by purchasing display inserts 30 depicting indicia from current television series or newly released films, the user can always have a lunch box which is current and in-vogue simply by interchanging the display inserts, will be able to use the lunch box during its entire useful life, and a parent can easily make the child's existing, perfectly functional, lunch box into what is perceived as a new, in style lunch box with substantial ease. Additionally, when cleaning the housing of the lunch box assembly, the display insert can be easily and effectively removed to prevent it from becoming worn or deteriorated as a result of many thorough washings.

It will be appreciated by those skilled in the art that the laminated card bearing indicia 34 imprinted on the display insert 30 may include several different types of images. In one embodiment, the laminated card bearing indicia 34 may include hologram images. Other possible alternatives, for example, include glow-in-the-dark, 3-Dimensional, heat-sensitive, and reflective images. Moreover, an interactive electronic image and mechanism can be incorporated in the display insert to allow a child to play a game, view a story, hear a pre-recorded message, etc. Further, the display inserts 30 can be used for other purposes such as trading or in wall frames when not being used.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An improved lunch box assembly comprising:

a main housing, said main housing including a lid portion and a base portion, said lid portion being hingedly secured to said base portion so as to provide access to an open interior of said main housing, said main housing including at least one exterior wall surface, a display panel, said display panel being secured in overlying relation to said one exterior wall surface so as to define a pocket therebetween, said display panel including a display opening defined therein and structured to provide visual access to said pocket between said display panel and said exterior wall surface, a display insert structured to be removably inserted into said pocket between said display panel and said exterior wall surface such that a primary display face thereof is visible through said display opening defined in said display panel, access means structured and disposed to permit removable access of said display insert into said pocket such that said display insert is securely maintained within said pocket when in use, and may be easily removed for convenient cleaning or interchanging thereof with a new display insert, said access means including a slot formed at an edge of said pocket and structured to permit the passage of said display insert therethrough, and said access means further including a pivotally secured lid structured to move between an open orientation wherein said slot is accessible and a closed orientation wherein said slot is concealed and removal of said display insert from said pocket is restricted.

2. An improved lunch box assembly as recited in claim 1 wherein said exterior wall surface is generally planer.

3. An improved lunch box assembly as recited in claim 1 wherein said display panel is integrally molded with said exterior wall surface.

4. An improved lunch box assembly as recited in claim 1 further including a plurality of said display inserts, each having a different indicia on said primary display surface thereof.

5. An improved lunch box assembly as recited in claim 1 wherein said display panel defines a frame at least partially about said display opening.

6. An improved lunch box assembly as recited in claim 1 wherein said display opening is covered by a transparent material panel.

7. An improved lunch box assembly as recited in claim 6 wherein said display panel and said transparent material panel disposed over said display opening are secured to said exterior wall surface so as to provide a substantially fluid impervious seal therewith.

8. An improved lunch box assembly as recited in claim 1 wherein said display insert includes a laminated card bearing indicia on at least said primary display surface thereof.

9. An improved lunch box assembly as recited in claim 1 wherein said primary display surface of said display insert includes a hologram image thereon.

10. An improved lunch box assembly comprising:

a main housing, said main housing including a lid portion and a base portion, said lid portion being hingedly secured to said base portion so as to provide access to an open interior of said main housing, said main housing including at least one exterior wall surface, a display panel, said display panel being secured in overlying relation to said one exterior wall surface so as to define a pocket therebetween, said display panel including a display opening defined therein and structured to provide visual access to said pocket between said display panel and said exterior wall surface, a display insert structured to be removably inserted into said pocket between said display panel and said exterior wall surface such that a primary display face thereof is visible through said display opening defined in said display panel, access means structured and disposed to permit removable access of said display insert into said pocket such that said display insert is securely maintained within said pocket when in use, and may be easily removed for convenient cleaning or interchanging thereof with a new display insert, said access means including a slot formed at an edge of said pocket and structured to permit the facilitated passage of said display insert therethrough, and said access means further including a securement assembly structured to selectively restrict removal of said display insert from said pocket through said slot.

* * * * *